US005306206A

United States Patent [19]

Abe

[11] Patent Number: 5,306,206

[45] Date of Patent: Apr. 26, 1994

[54] COIN FEEDING DEVICE

[75] Inventor: Hiroshi Abe, Tokyo, Japan

[73] Assignee: Asahi Seiko Kabushiki Kaisha, Tokyo, Japan

[21] Appl. No.: 904,238

[22] Filed: Jun. 25, 1992

[30] Foreign Application Priority Data

Jun. 26, 1991 [JP] Japan ..... 3-078625[U]

[51] Int. Cl.[5] ..... G07D 9/04

[52] U.S. Cl. ..... 453/32; 453/35; 453/57

[58] Field of Search ..... 453/31, 32, 33, 34, 453/35, 50, 57; 221/267

[56] References Cited

U.S. PATENT DOCUMENTS 4,752,274 6/1988 Abe ..... 453/57 X 4,923,430 5/1990 Iimura ..... 221/267 X

FOREIGN PATENT DOCUMENTS 2185341 7/1987 United Kingdom ..... 453/57

*Primary Examiner*—F. J. Bartuska

*Attorney, Agent, or Firm*—Hopgood, Calimafde, Kalil, Blaustein & Judlowe

[57] ABSTRACT

A coin feeding device is provided comprising a base plate adapted for mounting predetermined coins on one end thereof, including a scraper for scraping the coins towards the other or opposite end of the base plate along a predetermined coin feeding path. The scraper comprises a main rotating body rotatably mounted on the base plate and includes a coin feeding wing unit or finger assembly extending radially outwardly from the main rotating body. The coin feeding wing unit or finger assembly is used for feeding the coins to the other or opposite end of the base plate while traveling along the coin feeding path by virtue of the rotation of the main rotating body. The coin-feeding device includes a movable engagement piece biased to force one of the coins against the main rotating body along the coin feeding path.

6 Claims, 3 Drawing Sheets

COIN FEEDING DEVICE

BACKGROUND OF THE INVENTION

This invention relates to a coin feeding device, and more particularly, to such a device for properly feeding a plurality of coins and medals (hereinafter, "coins") to a chute communicating with the outside of the device.

Recently, demand for a coin feeding device has been increasing in various environments such as a gamehouse or a playhouse. Typical coin feeding device of the type described is disclosed in, for example, Japanese Patent Publication No. 63-36040 to the same applicant as the present invention. The coin feeding device comprises, a base plate, a scraper arrangement, a hollow cylindrical case, a coin feeding disc, an outlet, a coin counter, and a driving unit. A plurality of coins are mounted on one end of the base plate and delivered, one by one, by means of the coin feeding disc. The scraper arrangement scrapes the delivered coins from the coin feeding disc towards the other end of said base plate along a predetermined coin feeding path. More particularly, the scraper arrangement comprises a main rotating body and a coin feeding wing unit. The main rotating body is rotatably mounted on the base plate. The coin feeding wing unit or finger assembly has a plurality of wings or fingers which extend radially outwardly from the main rotating body. In this manner, the wings or fingers feed the coins to the other end of the base plate by means of rotation of the main rotating body. The coin counter is arranged besides the outlet to count the coin to be thrown out of the coin feeding device. The counter is operatively connected to an actuating lever and a switching roller. When the number of coins reaches a predetermined amount, electricity to the driving unit (e.g. an electric motor) is immediately interrupted. Simultaneously, rotation of a main rotating body is stopped by means of a damping device, as described in, for example, Japanese Utility Model Publication No. 63-49802 to the same applicant as the present invention. Thus, the predetermined number of coins are to be thrown out.

However, in the conventional coin feeding device as described above, the coins delivered to the outlet by the scraper arrangement continue to move due to its inertia force after the rotation of the main rotating body is stopped. As a consequence, when such inertia force is relatively large, the coin pushes the actuating lever aside and is thrown out of the device. That is, an overabundant coin is thrown out. On the other hand, in case where the inertia force is relatively small, the actuating lever is pushed back due to the returning force of a return spring attached to the actuating lever through the switching roller is actuated. This causes incorrect counting.

In particular, recent tendency of the coin feeding device demands reduction of the necessary time which is required for feeding a plurality coins staying in the game machine with respect to psychological desire of game players and managerial desire of playhouse managers. In order to satisfy such requirements, the rotation speed of the driving unit is increased. As a result, the above mentioned problems have been magnified because of the inertia force.

In order to solve the above mentioned problems, the applicant of the present invention had tried using a spring having a large spring constant as the aforementioned return spring. However, this only overcomes the problems regarding to the excessive feeding of the coin and incorrect counting for the thrown out coins. Other problems have been occurred such as destortion of the actuating lever because of the overloading thereon.

It is therefore an object of the present invention to provide a coin feeding device which perfectly avoid the excessive feeding of the coin and incorrect counting for the coins.

Other objects and advantages of the present invention will be clear as the description proceeds.

SUMMARY OF THE INVENTION

In accordance with an aspect of the present invention, a coin feeding device is provided comprising a base plate mounting predetermined coins on one end thereof, and a scraper means for scraping the coins towards the other end of the base plate along a predetermined coin feeding path. The scraper means comprises a main rotating body rotatably mounted on the base plate and a coin feeding wing unit or finger assembly. The coin feeding wing unit or finger assembly has a plurality of wings or fingers which are radially outwardly extending from the main rotating body. The wings or fingers are for use in feeding the coins to the other end of the base plate while traveling along the coin feeding path due to rotation of the main rotating body. A coin feeding device further comprises a case disposed on the base plate; an outlet provided to the case; a coin feeding disc rotatably supported on the base plate within the case; a coin receiving hole unit, or assembly having a diameter receivable for the coins and penetrating or passing through the coin feeding disc; coin feeding arms arranged between the coin feeding disc and the base plate for feeding the coins received in the coin receiving hole unit or assembly to the coin feeding path along with rotation of the coin feeding disc; an outlet guiding member for guiding the coins fed by the coin feeding arm; a throw chute disposed on the other end of the base plate; a coin counter arranged between the throw chute and the movable engagement piece for counting the number of coins passed through the coin feeding path; and a movable engagement piece for use in forcing one of the coins against the main rotating body on the coin feeding path.

The main rotating body is rotated in synchronism with the coin feeding disc, and the coin feeding wing unit or finger assembly scrapes, from the outlet to the coin feeding path, the coins guided to the outlet in cooperation with the coin feeding arm. The coin receiving hole unit or finger assembly may comprise a plurality of spaced holes disposed thereon along a circumference of the coin feeding disc. The coin feeding arm extends along a radius of the coin feeding disc substantially to a center or therearound of each of the plurality of holes. The coin feeding wing unit or finger assembly has a plurality of wings or fingers which is equal in number to the plurality of holes and radially extends along a radius of the main rotating body, wherein each of the plurality of wings fingers extend radially between the plurality of holes through the outlet.

In a coin feeding device according to the present invention, a movable engagement piece is provided which may comprise an arm portion with one end thereof pivotally supported on the base plate; and a forcing member cooperatively associated therewith for forcing the arm portion against the main rotating body.

Preferably, the arm portion is curved in shape and is disposed to face towards the main rotating body.

BRIEF DESCRIPTION OF DRAWINGS

For a better understanding of the invention as well as other objects and further features thereof, reference is made to the following detailed description to be read in conjunction with the accompanying drawings, wherein.

DETAILED DESCRIPTION OF THE INVENTION

Figure 1:
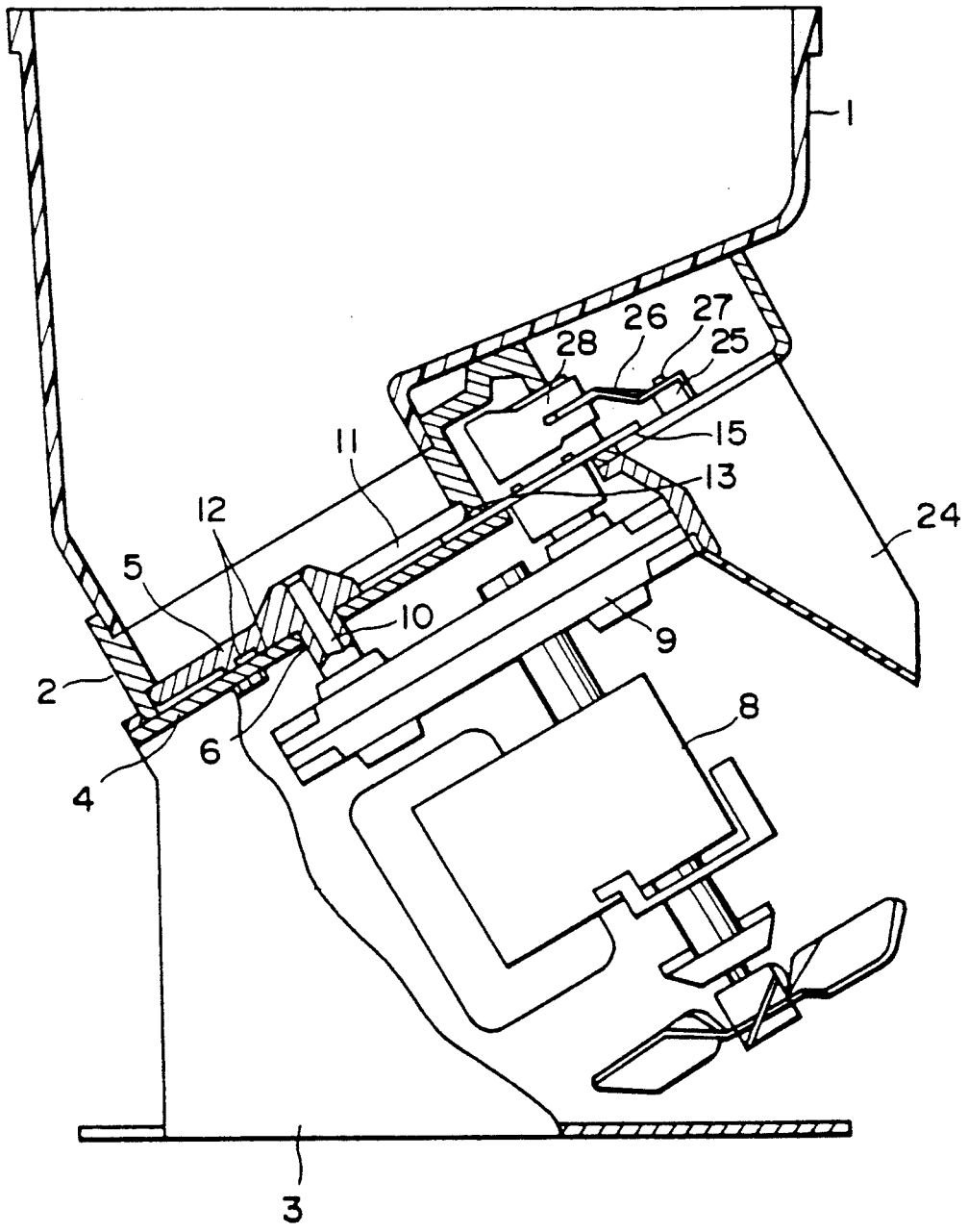
FIG. 1 PRIOR ART
FIG. 1 shows a side view of a part of a conventional coin feeding device.
Figure 3:
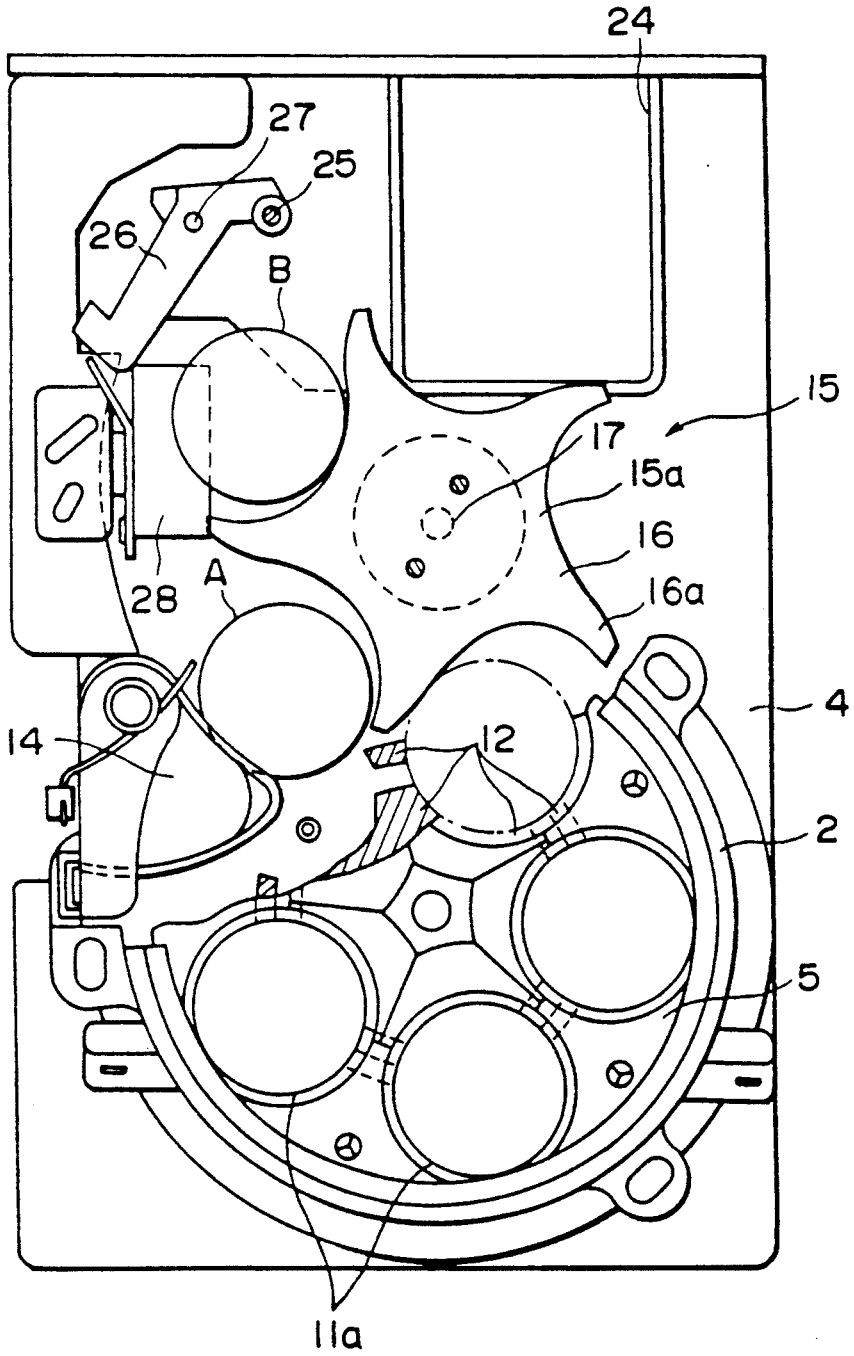
FIG. 3 PRIOR ART
FIG. 3 shows a top view of a conventional coin feeding device.

Referring to FIGS. 1 and 3, description will at first proceed to a conventional coin feeding device in order to facilitate an understanding of the present invention. In the drawings, a hopper 1 is shown which is for use in storing a plurality of coins. The lower end of the hopper 1, a hollow cylindrical case 2 is attached. A predetermined number of coins are mounted or disposed on one end of a base plate 4. The hollow cylindrical case 2 is disposed on the base plate 4 with an outlet 13 (FIG. 1) provided thereto. A coin feeding disc 5 is rotatably supported on the base plate 4 within the hollow cylindrical case 2. In the coin feeding disc 5, a coin receiving hole unit 11 is provided. The coin receiving hole unit 11 comprises a plurality of coin receiving holes 11*a* disposed thereon along a circumference of the coin feeding disc 5 with being apart from each other. Each of the coin receiving holes 11*a* has a diameter which is slightly larger than that of the coin for properly receiving the coin.

A disc boss 6 disposed on the coin feeding disc 5 is pivotally supported in a pivot bore 7 disposed on the base plate 4. The disc boss 6 is fastened to a coin feeding disc rotation shaft 10 driven by a driving unit 8 through a reduction gear 9, thereby the coin feeding disc 5 can be concentrically rotated in the hollow cylindrical case 2.

Coin feeding arms 12 are arranged between the base plate 4 and the coin feeding disc 5. Each of the coin feeding arms 12 extends along a radius of the coin feeding disc 5 substantially to a center or therearound of each of the coin receiving holes 11*a*. The coin feeding arms 12 feed coins received each of the coin receiving hole 11 to a coin feeding path 18 by means of rotation of the coin feeding disc 5. Thus, coins are received by the coin receiving holes 11*a* and delivered on the base plate 4 by means of the coin feeding arms 12 as the coin feeding disc 5 is rotated.

A scraper arrangement 15 is installed on the base plate 4 adjacent with the coin feeding disc 5. The scraper arrangement 15 scrapes the coins towards the other or opposite end of the base plate 4 along the predetermined coin feeding path. The scraper arrangement 15 comprises a main rotating body 15*a* and a coin feeding wing unit or finger assembly 16. The main rotating body 15*a* is rotatably mounted on the base plate 4 with a scraper rotation axis 17. The coin feeding wing unit or finger assembly 16 has a plurality of wings or fingers 16*a* which are equal in number to said plurality of holes 11*a* and radially extends along a radius of the main rotating body 15*a*. Each of the plurality of wings or fingers 16*a* has extremity projecting or extending to each of the corresponding coin feeding holes 11*a* through the outlet 13. The wings or fingers 16*a* feed the coins to the other end of the base plate 4 while traveling along the coin feeding path.

The coins fed by the coin feeding arms 12 are delivered, at first, towards the scraper arrangement 15 by means of an outlet guiding member 14. The main rotating body 15*a* is rotated in synchronism with the coin feeding disc 5 so that each of the wings or fingers 16*a* can scrape the coin from the outlet 13 to the feeding path in cooperation with the coin feeding arms 12. A throw chute 24 is disposed on the other end of the base plate 4. Between the outlet 13 and a throw chute 24, there is provided the coin feeding path 18 for passing the coins. In the coin feeding path 18, a switching roller 25 is attached to an actuating lever 26. The switching roller 25 is arranged in a position where an actuating lever 26 can be contacted with the coins to be thrown out. The actuating lever 26 is constructed so as to ensure actuation of a count adjusting switch 28 with being rotatable about a pivotal axis 27. In addition, the actuating lever 26 is always forced to the coin feeding path 18 by a helical torsion coil spring.

Figure 2:
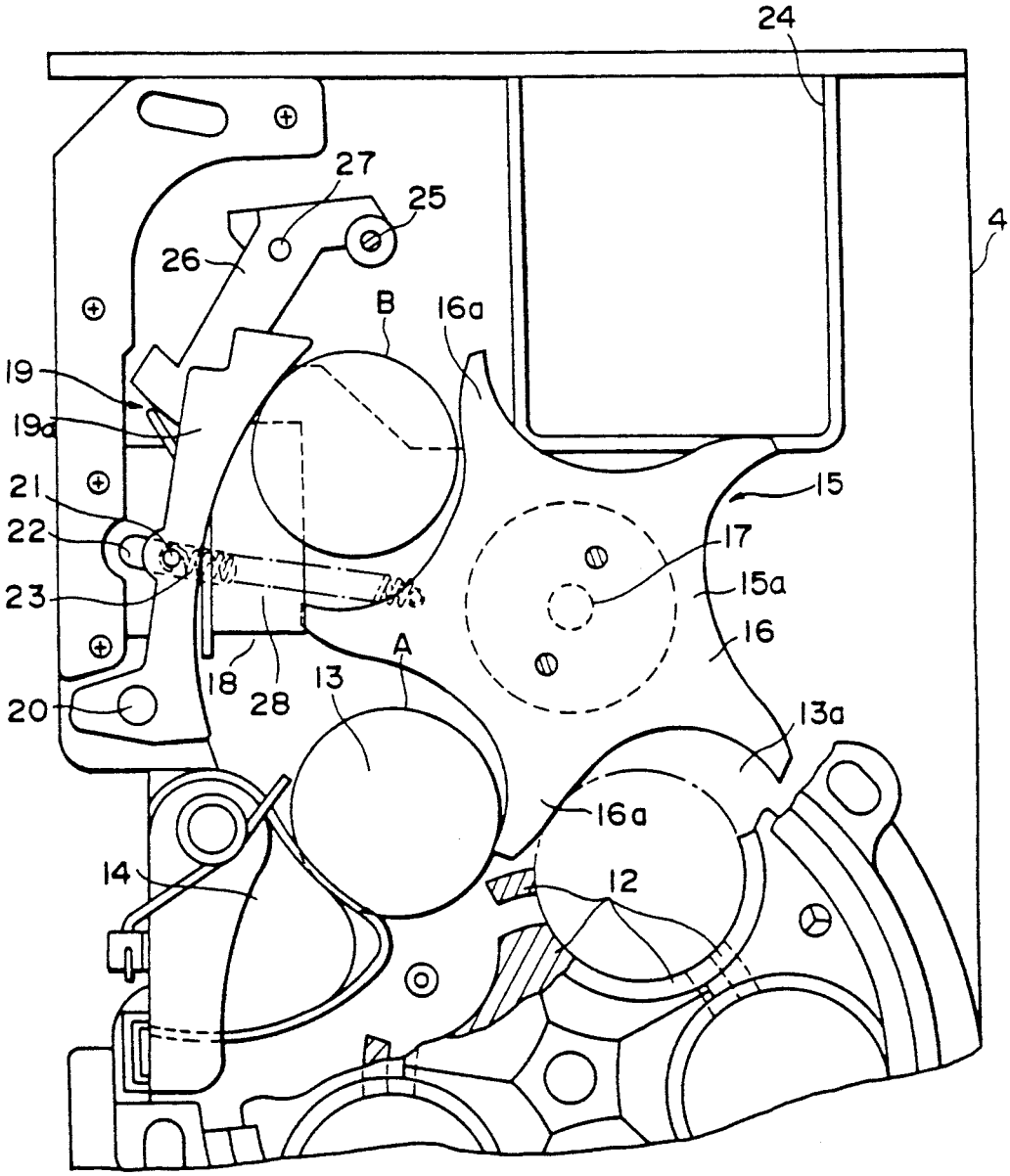
FIG. 2 shows a partial expansion view of a scraper arrangement and surroundings thereof in the coin feeding device according to the present invention.

FIG. 2 shows an embodiment of a coin feeding device according to the present invention. The coin feeding device illustrated in FIG. 2 comprises similar parts designated by like reference numerals as in FIGS. 1 and 3. Description of such parts will be omitted for the purpose of brevity of the description. The coin feeding device comprises a movable engagement piece 19 adapted by means to force one of the coins against the main rotating body 15 on the coin feeding path. The movable engagement piece 19 comprises an arm portion 19*a* and a forcing or biasing member 23. The movable engagement piece 19 is pivotally mounted about a pivot pin 20 along the coin feeding path 18 at the opposite side to the scraper arrangement 15. A securing pin 21 is secured to the movable engagement piece 19 at the lower surface of an approximately central position thereof. The securing pin 21 is projected through and beneath the base plate 4 where a long bore 22 bored through the base plate 4. Thus, the movable pivotally mounted engagement piece 19 is biased or forced into the direction of scraper arrangement 15.

Preferably, the arm portion 19*a* is curved along an edge thereof towards the main rotating body 15*a*. In other words, the edge of arm portion 19*a* of the movable engagement piece 19 has an approximately circular or arc configuration so that coins to be thrown can be smoothly delivered while in contact relation therewith. The forcing or biasing member 23 is for use in forcing the movable engagement piece 19 against a coin in contact therewith. More particularly, the forces member 23 elastically forcing the movable engagement piece 19 towards the scraper 15 while allowing the arm portion 19*a* to engage the coins, one by one, which are successively delivered. In this manner, delivery of overabundant coins can be prevented by the movable engagement piece 19 in cooperation with the scraper arrangement 15. It is noted that in the illustrated embodiment, the forcing or biasing member 23 is an extension spring which may be substituted by other means such as a helical torsion coil spring.

What is claimed is:

1. A coin-feeding device comprising:

a base plate having a one end portion and an opposite end portion and adapted to receive a predetermined type of coins on said one end portion, a scraper means for scraping coins deposited at said one end portion and for delivering said coins to said opposite end portion along a predetermined coin-feeding path, said scraper means comprising a main rotating body rotatably mounted on said base plate, an outlet guiding member for guiding the coins towards said scraper means, said main rotating body having a coin-feeding finger unit or assembly comprising a plurality of spaced fingers extending radially outward from said main rotating body, said coin-feeding finger unit or assembly being adapted for feeding said coins from said one end portion to said opposite end portion while traveling along said coin-feeding path by means of the rotation of said main rotating body; and a movable engagement piece disposed along said coin-feeding path and adapted to force successively each one of said coins against said main rotating body along said coin-feeding path.

2. The coin-feeding device as in claim 1, wherein said movable engagement piece comprises:

an arm portion pivotally mounted at said one end portion to said base plate; and forcing means cooperatively associated with said pivotally mounted arm portion for forcing said arm portion against said main rotating body.

3. A coin-feeding device as in claim 2 which comprises:

a discharge chute disposed at said opposite end portion of said base plate; and a coin counter arranged between said discharge chute and said movable engagement piece for counting the number of coins passing through said coin feeding path.

4. The coin-feeding device as in claim 2, wherein said arm portion is curved along its edge to provide an approximate circular or arc configuration facing said rotating body so that the coins to be discharged can be smoothly delivered while in contact with the curved portion of said arm.

5. The coin-feeding device as in claim 2, which comprises:

a case for said coins mounted on said base plate with an outlet provided thereon;

a coin-feeding disc disposed within said case rotatably supported on said base plate, a coin-receiving hole unit or assembly comprising a plurality of spaced coin-receiving holes each having a diameter of size sufficient to receive a coin therein; said coin-receiving holes passing through said coin-feeding discs;

coin-feeding arms arranged between said coin-feeding disc and said base plate for feeding coins disposed in said coin-receiving holes to said coin-feeding path along with the rotation of said coin-feeding disc; and an outlet guiding member for guiding said coins fed by said coin-feeding arms, wherein the main rotating body is rotated in synchronism with said coin-feeding disc; and wherein said coin-feeding finger unit or assembly scrapes the coins from said outlet to said coin-feeding path, said coins being guided to said outlet in cooperation with said coin-feeding arm.

6. The coin-feeding device as in claim 5 in which said coin-receiving hole unit or assembly comprises:

a plurality of spaced coin-receiving holes circumferentially disposed about said coin-feeding disc, said coin-feeding arm extending along a radius of said coin-feeding disc substantially to the center of each of said spaced coin-receiving holes, said coin-feeding finger unit or assembly having a plurality of fingers equal in number to said plurality of coin-receiving holes with each finger extending along a radius of said main rotating body, and wherein each finger extends radially between said plurality of spaced coin-receiving holes.

* * * * *